US005935021A

United States Patent [19]

Kashiwagi et al.

[11] Patent Number: 5,935,021

[45] Date of Patent: Aug. 10, 1999

[54] GOLF BALL

[75] Inventors: Shunichi Kashiwagi; Yasushi Ichikawa; Rinya Takesue, all of Chichibu, Japan

[73] Assignee: Bridgestone Sports Co., Ltd., Tokyo, Japan

[21] Appl. No.: 08/969,545

[22] Filed: Nov. 13, 1997

[30] Foreign Application Priority Data

Nov. 13, 1996 [JP] Japan ..... 8-317106

[51] Int. Cl.[6] ..... A63B 37/12

[52] U.S. Cl. ..... 473/365; 473/372; 473/385; 473/377; 524/405

[58] Field of Search ..... 473/356, 365, 473/357, 372, 377, 378, 385

[56] References Cited

U.S. PATENT DOCUMENTS

| | | | |
|---|---|---|---|
| 4,955,613 | 9/1990 | Gendreau et al. | 473/372 |
| 5,141,233 | 8/1992 | Yuki et al. | 473/372 X |

FOREIGN PATENT DOCUMENTS

| | | |
|---|---|---|
| 57-25867 | 2/1982 | Japan . |
| 6-198006 | 7/1994 | Japan . |

*Primary Examiner*—George J. Marlo
*Attorney, Agent, or Firm*—Sughrue, Mion, Zinn, Macpeak & Seas, PLLC

[57] ABSTRACT

A golf ball having a cover is provided. The cover is formed of a cover stock comprising a thermoplastic resin or elastomer and fibrous aluminum borate whiskers. The cover is durably resistant to damages by iron shots.

7 Claims, No Drawings

GOLF BALL

BACKGROUND OF THE INVENTION

1. Field of the Invention

This invention relates to a golf ball having improved restitution and improved durability in terms of cut resistance and scuff resistance upon iron shots.

2. Prior Art

Golf balls known in the art include one-piece golf balls, solid golf balls, and wound golf balls. The one-piece golf balls are generally prepared by heat curing a rubber composition comprising polybutadiene, methacrylic acid, zinc oxide and peroxide. The solid golf balls including two- and three-piece golf balls are generally prepared by heat curing a rubber composition comprising polybutadiene, zinc acrylate and peroxide to form a solid core and molding a cover around the core with an intermediate layer optionally interposed therebetween. The wound golf balls are generally prepared by molding a cover around a wound core.

Most commonly used as the cover stock in these balls are thermoplastic resins such as ionomer resins and thermoplastic elastomers such as thermoplastic polyester elastomers and polyurethane. The covers formed from thermoplastic resins and thermoplastic elastomers as a main component are resilient, but relatively prone to damage. Especially on iron shots, the covers are readily indented by the club face and scuffed thereby to become fluffy or scraped on the surface.

Then, various proposals have been made for improving the durability of the cover in terms of cut resistance and scuff resistance. For example, JP-A 25867/1982 discloses a cover stock comprising an ionomer resin, an inorganic reinforcement in the form of inorganic glass fibers, and an organic binder. JP-A 311973/1988 discloses a cover stock comprising a synthetic or natural rubber in admixture with surface treated alkali metal titanate fibers. The inorganic glass fibers used in the former do not provide sufficient reinforcement since they are not uniformly dispersible due to their insufficient fiber shape (that is, a low aspect ratio). The inorganic glass fibers rather detract from the resilience of the resin. The alkali metal titanate used in the latter has a low modulus of elasticity and hence, detracts from the resilience of the resin. That is, the alkali metal titanate does not fully satisfy the reinforcement requirement and can deteriorate resin properties.

JP-A 198006/1994 discloses to blend an ionomer resin with needle titanium dioxide. This filler still fails to achieve satisfactory reinforcement.

SUMMARY OF THE INVENTION

Therefore, an object of the present invention is to provide a novel and improved golf ball whose cover is durably cut resistant and scuff resistant and which has improved restitution.

The invention is directed to a golf ball comprising a cover which is formed of a cover stock comprising a thermoplastic resin or elastomer as a main component. We have found that by blending fibrous aluminum borate whiskers in the cover stock, there is obtained a golf ball which is not only good in rebound, but also fully durable in that the cover is resistant to indentation by the club face upon iron shots and prevents the occurrence of scuffs, scrapes and cracks.

Of the components known in the prior art as imparting durability to the cover, some are less reinforcing because of the geometrical and modulus factors of themselves, and some are detrimental to restitution because they place a too much stress on cut resistance and scuff resistance. It was thus difficult to produce a cover satisfying both restitution and cut/scuff resistance. Fibrous aluminum borate whiskers are very fine white needle crystals as compared with glass fibers, have high strength and high tensile modulus, and are chemically neutral. When fibrous aluminum borate whiskers are blended with a thermoplastic resin or elastomer, the whiskers are uniformly dispersed in the resin or elastomer so that the cover formed therefrom is fully resilient and durably resistant to iron shots. The present invention is predicated on this finding.

According to the invention, there is provided a golf ball comprising a cover which is formed of a cover stock comprising a thermoplastic resin or elastomer and fibrous aluminum borate whiskers.

DETAILED DESCRIPTION OF THE INVENTION

In the golf ball of the invention, the cover stock contains a thermoplastic resin or thermoplastic elastomer as a main component and fibrous aluminum borate whiskers as a filler.

The thermoplastic resin used as the main component of the cover stock may be selected from well-known ones, preferably ionomer resins. Commercially available examples of the ionomer resin include Himilan 1605 (sodium ion neutralization type) and Himilan 1706 (zinc ion neutralization type) by Mitsui duPont Polychemical K.K. and Surlyn 8120 (sodium ion neutralization type) and Surlyn 7930 (lithium ion neutralization type) by E. I. dupont. These ionomer resins may be used alone or in admixture of two or more.

The thermoplastic elastomer used herein includes thermoplastic polyester elastomers, thermoplastic polyurethane elastomers, and thermoplastic polyamide elastomers. They are commercially available. Exemplary thermoplastic polyester elastomers are Hytrel 4047 and Hytrel 4767 by Toray duPont K.K.; an exemplary thermoplastic polyurethane elastomer is Pandex T7890 by Dai-Nihon Ink Chemical Industry K.K.; and an exemplary thermoplastic polyamide elastomer is Pabex 4033SNOO by Atochem of France. These elastomers may be used alone or in admixture of two or more. A mixture of a thermoplastic resin and a thermoplastic elastomer is also useful.

To enhance the restitution and improve the durability in terms of cut resistance and scuff resistance of the cover stock, according to the invention, fibrous aluminum borate whiskers are blended in the cover stock. The fibrous aluminum borate whiskers are very fine (that is, a high aspect ratio) white needle crystals as compared with glass fibers, so that white coloring may be readily achievable. That is, the whiskers are also improved in the coloring of the cover. The whiskers have high strength and high tensile modulus. Additionally, the whiskers ensure uniform dispersion and uniform reinforcement. That is, the whiskers can be readily mixed with the thermoplastic resin or elastomer to form a uniform blend.

The fibrous aluminum borate whiskers are commercially available, for example, under the trade name of Alborex Y and Alborex T3A from Shikoku Chemicals K.K.

Although the shape of fibrous aluminum borate whiskers is not particularly limited, the preferred fibrous aluminum borate whiskers have a mean fiber length of 5 to 50 $\mu$m, especially 10 to 30 $\mu$m and a mean fiber diameter of 0.1 to 2 $\mu$m, especially 0.5 to 1 $\mu$m. Whiskers with a mean fiber length of less than 5 $\mu$m would sometimes fail to provide sufficient reinforcement with respect to the durability of scuff resistance. Whiskers with a mean fiber length of more than 50 μm would lack uniform dispersing and reinforcing abilities because of their rough fiber shape, failing to achieve sufficient reinforcement to provide durability and detracting from the flow of the resin. Whiskers with a mean fiber diameter of less than 0.1 μm are weak so that they may be broken upon kneading, failing to achieve reinforcement. Whiskers with a mean fiber diameter of more than 2 μm would lack uniform dispersing and reinforcing abilities because of their rough fiber shape, failing to achieve sufficient reinforcement to provide durability. It is noted that the mean fiber length and diameter are measured by microscopy.

On use, the fibrous aluminum borate whiskers are preferably surface treated with various surface treating agents to improve the miscibility thereof. Any of well-known surface treating methods may be used although surface treatment with silane coupling agents is preferred. Exemplary silane coupling agents include γ-methacryloxypropyltrimethoxysilane, γ-aminopropyltriethoxysilane, and β-(3,4-epoxycyclohexyl) ethyltrimethoxysilane.

No particular limit is imposed on the amount of fibrous aluminum borate whiskers blended although an appropriate amount is 1 to 20 parts, especially 3 to 10 parts by weight per 100 parts by weight of the thermoplastic resin or elastomer. Less than 1 part of whiskers is too small to impart cut resistance and scuff resistance. More than 20 parts of whiskers can deteriorate the resilience of the cover.

In the cover stock, various additives such as coloring agents, lubricants and fillers may be blended in addition to the above-mentioned components, if desired and insofar as the objects of the invention are not impaired. Examples of the coloring agent include titanium oxide, barium sulfate, Prussian blue, red iron oxide, chrome yellow, and fluorescent coloring pigments. Examples of the lubricant include magnesium stearate, aluminum stearate, and calcium stearate. Examples of the filler include calcium carbonate, talc, and glass fibers. The cover can be prepared by mixing properly selected ingredients in a conventional mixer, for example, closed kneading machines, single and twin screw extruders and molding the resulting cover stock by well-known conventional techniques such as compression molding and injection molding.

The cover stock may be used to form the cover of solid golf balls such as two- and three-piece balls or the cover of wound golf balls. The cores of the solid and wound golf balls may be of well-known construction.

The cover preferably has a gage of 1.0 to 2.5 mm, especially 1.2 to 2.1 mm although the gage is not critical. The cover may be a single layer cover or a cover of two or more layers. Dimples can be formed in the cover by conventional techniques.

The golf ball of the invention may be adjusted to a weight and diameter complying with the Rules of Golf.

EXAMPLE

Examples of the invention are given below by way of illustration and not by way of limitation.

Two-piece solid golf balls were prepared by milling a rubber composition of the formulation shown below and molding and vulcanizing it at 155° C. for 20 minutes to form a solid core. A cover stock was formulated by blending the components shown in Table 2 and kneading them in a twin screw extruder, and injection molded over the core. Note that Table 1 shows the properties of fillers and Table 2 shows the amounts of components blended.

Solid core composition Parts by weight

| Solid core composition | Parts by weight |
|---|---|
| Polybutadiene rubber (BR01 by Nippon Synthetic Rubber K.K.) | 100 |
| Zinc acrylate | 27 |
| Zinc oxide | 10 |
| Barium sulfate | 12.5 |
| Dicumyl peroxide | 0.9 |

The golf balls were examined for restitution and durability in terms of cut and scuff resistance by the following methods.

Restitution

After the ball was kept at 23° C., an initial velocity (m/s) was measured using a meter as prescribed in USGA.

Durability

The ball was kept at 23° C. By using a swing robot of True Temper Co. and swinging a pitching wedge at a head speed of 37 m/sec., the ball was hit at three spots. The ball was observed to examine how the hit spots were damaged. The ball was rated on a five-point scale.

5: no change on the ball surface, or slight club face indents are left, but not so noticeable 4: club face indents are left, but the ball surface is not fluffy 3: the ball surface is fluffy and scuffed 2: the ball surface is fluffy and cracked 1: dimples are scraped The results are shown in Table 2.

TABLE 1

| | Outer appearance/ shape | Mean fiber length (μm) | Mean fiber diameter (μm) | Mohs hardness | Tensile strength (kgf/mm) | Tensile modulus (tonf/mm$^2$) |
|---|---|---|---|---|---|---|
| Aluminum borate whiskers[1)] | white needle crystal | 10–30 | 0.5–1.0 | 7 | 800 | 40 |
| Potassium titanate[2)] | white needle crystal | 10–20 | 0.3–0.6 | 4 | 700 | 28 |
| Glass fibers[3)] | — | 30–300 | 10 | — | — | — |

[1)]Aluminum borate whiskers: Alborex Y3A (surface treated with aminosilane coupling agent) by Shikoku Chemicals K.K.
[2)]Potassium titanate: Tismo-D by Otsuska Chemical K.K.
[3)]Glass fibers: Milled Fiber by Asahi Fiber Glass K.K.

TABLE 2

| | E1 | E2 | E3 | E4 | E5 | E6 | CE1 | CE2 | CE3 | CE4 | CE5 |
|---|---|---|---|---|---|---|---|---|---|---|---|
| Ionomer resin[4)] | 100 | 100 | — | — | — | — | 100 | — | — | 100 | 100 |
| TPEE[5)] | — | — | 100 | 100 | — | — | — | 100 | — | — | — |
| TPU[6)] | — | — | — | — | 100 | 100 | — | — | 100 | — | — |
| Aluminum borate whiskers | 5 | 10 | 5 | 10 | 5 | 10 | — | — | — | — | — |
| Glass fibers | — | — | — | — | — | — | — | — | — | 10 | — |
| Potassium titanate | — | — | — | — | — | — | — | — | — | — | 10 |
| Initial velocity (m/s) | 77.0 | 76.9 | 76.8 | 76.8 | 76.5 | 76.5 | 77.0 | 76.8 | 76.5 | 76.7 | 76.9 |
| Durability | 5 | 5 | 5 | 5 | 5 | 5 | 3 | 2 | 4 | 4 | 4 |

[4)]Ionomer resin: Himilan 1855 by Mitsui duPont Polychemical K.K.
[5)]TPEE: Hytrel 4767 by Toray duPont K.K.
[6)]TPU: Pandex T7890 by Dai-Nihon Ink Chemical Industry K.K.

There has been described a golf ball having improved restitution, improved durability, and high resistance to indentation upon iron shots.

Japanese Patent Application No. 317106/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a cover which is formed of a cover stock comprising a thermoplastic resin or elastomer and fibrous aluminum borate whiskers.

2. The golf ball of claim 1 wherein the fibrous aluminum borate whiskers have a mean fiber length of 5 to 50 $\mu$m and a mean fiber diameter of 0.1 to 2 $\mu$m.

3. The golf ball of claim 1 wherein the fibrous aluminum borate whiskers have been surface treated with a silane coupling agent.

4. The golf ball of claim 1 wherein the cover stock contains 100 parts by weight of the thermoplastic resin or elastomer and 1 to 20 parts by weight of the fibrous aluminum borate whiskers.

5. The golf ball of claim 1 wherein the thermoplastic resin or elastomer is an ionomer resin, thermoplastic polyester elastomer, thermoplastic polyurethane elastomer or thermoplastic polyamide elastomer.

6. The golf ball of claim 1 which is a solid golf ball.

7. The golf ball of claim 1 which is a wound golf ball.

* * * * *

UNITED STATES PATENT AND TRADEMARK OFFICE

CERTIFICATE OF CORRECTION

PATENT NO. : 5,935,021

DATED : August 10, 1999

INVENTOR(S) : Shunichi Kashiwagi, et al.

It is certified that error appears in the above-identified patent and that said Letters Patent is hereby corrected as shown below:

Colum 1, line 24, after "covers" insert --are--.

Colum 1, line 26, after "but" insert --are--.

Colum 1, line 59, change "We" to --The inventors--.

Column 2, after line 16, insert:

--BRIEF DESCRIPTION OF THE DRAWINGS

FIG. 1 is a partially broken away view of the golf ball according to this invention.--.

Column 2, line 49, after "whiskers" insert --1''--.

Column 2, line 59, after "whiskers" insert --1''--.

Column 2, line 63, after "whiskers" insert --1''--.

UNITED STATES PATENT AND TRADEMARK OFFICE

CERTIFICATE OF CORRECTION

PATENT NO. : 5,935,021

DATED : August 10, 1999

INVENTOR(S) : Shunichi Kashiwagi, et al.

It is certified that error appears in the above-identified patent and that said Letters Patent is hereby corrected as shown below:

Colum 3, line 14, delete "On use, the" and insert --The--.

Colum 3, line 24, after "whiskers" insert --1''--.

Colum 3, line 30, after "stock" insert --1'--.

Column 2, after "cores" insert --2--.

Colum 3, line 53, after "Dimples" insert --3--.

Column 5, lines 21 and 22, delete in their entirety.

UNITED STATES PATENT AND TRADEMARK OFFICE

CERTIFICATE OF CORRECTION

PATENT NO. : 5,935,021

DATED : August 10, 1999

INVENTOR(S) : Shunichi Kashiwagi, et al.

It is certified that error appears in the above-identified patent and that said Letters Patent is hereby corrected as shown below:

Add new claims 8, 9, and 10.

--8. The golf ball of Claim 1, wherein the fibrous aluminum borate whiskers have a mean fiber length of 10-30 μm and a mean fiber diameter of 0.5 to 1μm.--

--9. The golf ball of Claim 1, wherein said fibrous aluminum borate whiskers are white needed crystals.--

--10. The golf ball of Claim 1, wherein said cover has a gage in the range of 1.0 to 2.5mm.--

Signed and Sealed this

Fifth Day of December, 2000

*Attest:*

*Attesting Officer*

Q. TODD DICKINSON

*Director of Patents and Trademarks*